US011119439B2

(12) United States Patent
Osawa

(10) Patent No.: US 11,119,439 B2
(45) Date of Patent: Sep. 14, 2021

(54) IMAGE FORMING APPARATUS INCLUDING AN OPENING/CLOSING UNIT WITH A FIRST CLOSED POSITION FOR FORMING A CONVEYANCE PATH

(71) Applicant: CANON KABUSHIKI KAISHA, Tokyo (JP)

(72) Inventor: Yuichiro Osawa, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/933,839

(22) Filed: Jul. 20, 2020

(65) Prior Publication Data

US 2021/0034009 A1 Feb. 4, 2021

(30) Foreign Application Priority Data

Jul. 30, 2019 (JP) ..... JP2019-140183
Jul. 30, 2019 (JP) ..... JP2019-140184

(51) Int. Cl.
*G03G 21/00* (2006.01)
*G03G 21/16* (2006.01)

(52) U.S. Cl.
CPC ..... *G03G 21/1633* (2013.01); *G03G 21/168* (2013.01); *G03G 21/1638* (2013.01); *G03G 2215/00544* (2013.01)

(58) Field of Classification Search
CPC ..... G03G 21/1633; G03G 21/1638; G03G 21/168; G03G 21/1695; G03G 2215/00544; G03G 2221/1642; G03G 2221/1687; G03G 2221/1675
USPC ..... 399/124
See application file for complete search history.

(56) References Cited

U.S. PATENT DOCUMENTS 9,092,002 B2 * 7/2015 Shimoi ..... G03G 21/168
9,323,212 B2 * 4/2016 Fukase ..... G03G 21/1633
10,603,935 B1 * 3/2020 Yasui ..... B41J 23/02
2010/0003051 A1 * 1/2010 Sekina ..... G03G 15/1615 399/121

(Continued)

FOREIGN PATENT DOCUMENTS

JP 2008216595 A * 9/2008
JP 2009251135 A * 10/2009

(Continued)

*Primary Examiner* — Robert B Beatty
(74) *Attorney, Agent, or Firm* — Canon U.S.A., Inc. IP Division

(57) ABSTRACT

An image forming apparatus includes an opening/closing unit configured to take a first closed position and a first open position, and a rotatable member configured to take a second closed position for covering an opening to form a double-sided conveyance path, and a second open position for opening the double-sided conveyance path. The unit includes an engaging portion with a portion to be engaged, an interlock shaft rotatable with the engaging portion, and a gripping portion configured to rotate the interlock shaft, the engaging portion to position the unit at the first closed position. When the opening/closing member moves from the second closed position to the second open position, a protruding portion engages with the gripping portion of the unit positioned at the first closed position to rotate the engaging portion through the gripping portion to release the engagement to enable movement.

13 Claims, 13 Drawing Sheets

(56) References Cited

U.S. PATENT DOCUMENTS

| | | | | |
|---|---|---|---|---|
| 2012/0148302 | A1* | 6/2012 | Lee | G03G 15/161 399/121 |
| 2015/0346646 | A1* | 12/2015 | Koshida | G03G 15/1605 399/121 |
| 2017/0060078 | A1* | 3/2017 | Uohashi | G03G 15/234 |
| 2018/0150021 | A1* | 5/2018 | Yamamoto | G03G 21/168 |
| 2019/0064728 | A1* | 2/2019 | Shima | G03G 21/168 |

FOREIGN PATENT DOCUMENTS

| | | | | | |
|---|---|---|---|---|---|
| JP | 2010015060 | A | * | 1/2010 | |
| JP | 2012194508 | A | * | 10/2012 | G03G 21/1633 |
| JP | 2015-163960 | A | | 9/2015 | |

* cited by examiner

ONE END SIDE

THE OTHER END SIDE

ONE END SIDE

THE OTHER END SIDE

IMAGE FORMING APPARATUS INCLUDING AN OPENING/CLOSING UNIT WITH A FIRST CLOSED POSITION FOR FORMING A CONVEYANCE PATH

BACKGROUND

Field of the Disclosure

The present disclosure generally relates to an image forming apparatus, such as a copying machine or a printer, which employs an electrophotographic process, and more particularly, to a lock mechanism for opening or closing a door in jam processing.

An image forming apparatus forms an image on a recording medium by an electrophotographic process. Examples of the image forming apparatus include an electrophotographic copying machine, an electrophotographic printer (e.g., a laser beam printer and a light-emitting diode (LED) printer), a facsimile apparatus, and a word processor.

Description of the Related Art

In an image forming apparatus, such as a printer, which uses an electrophotographic process, an electrophotographic photosensitive member serving as an image bearing member is uniformly charged and a latent image is formed by selectively exposing the surface of the electrophotographic photosensitive member to light. Then, the latent image is developed with developer (toner) to form a toner image (developer image) as a visible image. The toner image is transferred onto a recording medium. There are two types of color image forming apparatuses. More particularly, there is an image forming apparatus of a type that directly transfers a toner image from an image bearing member onto a recording medium, and an image forming apparatus of a type that transfers a toner image onto an intermediate transfer member once and then secondarily transfers the toner image from the intermediate transfer member onto a recording medium. In the latter case, an intermediate transfer belt is often used as the intermediate transfer member, and a secondary transfer roller is strongly urged against the intermediate transfer belt to form a nip. The recording medium is caused to pass through the nip to transfer the toner image onto the recording medium from the intermediate transfer belt. After that, heat and pressure are applied to the transferred toner image to fix and record the toner image on the recording medium.

In the configuration described above, the secondary transfer roller and components surrounding the secondary transfer roller may be integrally formed as a secondary transfer unit to, for example, facilitate the jam processing, and the unit may be rotated around an apparatus main body to expose a conveyance path (Japanese Patent Application Laid-Open No. 2015-163960). In this case, an urging reaction force acting on the intermediate transfer belt is applied to the secondary transfer unit. Therefore, a mechanism for locking the secondary transfer unit in the apparatus main body against the force may be desirably used. It may be desirable to provide a plurality of such lock mechanisms (engaging portions) to distribute the reaction force. On the other hand, in the case of closing the secondary transfer unit, some of the plurality of lock mechanisms cannot be normally locked due to the reaction force applied from the secondary transfer roller or the like. This may cause a malfunction or failure. Accordingly, a configuration is known in which a portion in the vicinity of the center of the lock mechanism is pressed to normally lock the mechanism.

SUMMARY

According to the art, in which a mechanism for locking a secondary transfer unit in an apparatus main body and an opening/closing member for covering the secondary transfer unit are provided, there is a need to perform not only locking/unlocking operations for the mechanism for locking the secondary transfer unit in the apparatus main body, but also to perform opening/closing operations for the opening/closing member during jam processing. The present disclosure includes an image forming apparatus with improved usability.

According to an aspect of the present disclosure, an image forming apparatus includes an apparatus main body including an image forming portion, an opening/closing unit provided to be rotatable relative to the apparatus main body and configured to take a first closed position for forming a conveyance path through which a recording material on which an image is formed is conveyed, and a first open position for opening the conveyance path, and an opening/closing member provided to be rotatable relative to the apparatus main body and configured to take a second closed position for covering an opening provided in the apparatus main body that exposes the opening/closing unit to form a double-sided conveyance path, and the second open position for opening the double-sided conveyance path. The opening/closing unit includes an engaging portion configured to engage with a portion of the apparatus main body to be engaged, an interlock shaft configured to be rotatable in conjunction with the engaging portion and to be parallel to a rotation axial direction of the opening/closing unit, and a gripping portion configured to rotate the interlock shaft, the engaging portion engaging with the portion to be engaged to position the opening/closing unit at the first closed position. The opening/closing member includes a protruding portion configured to enable a movement from the closed position to the first open position such that the protruding portion engages with the gripping portion of the opening/closing unit positioned at the first closed position when the opening/closing member moves from the second closed position to the second open position, and rotates the engaging portion through the gripping portion to release the engagement with the portion to be engaged.

Further features of the present disclosure will become apparent from the following description of exemplary embodiments with reference to the attached drawings.

DESCRIPTION OF THE EMBODIMENTS

Overall Schematic Configuration of Example of Image Forming Apparatus

Figure 13:
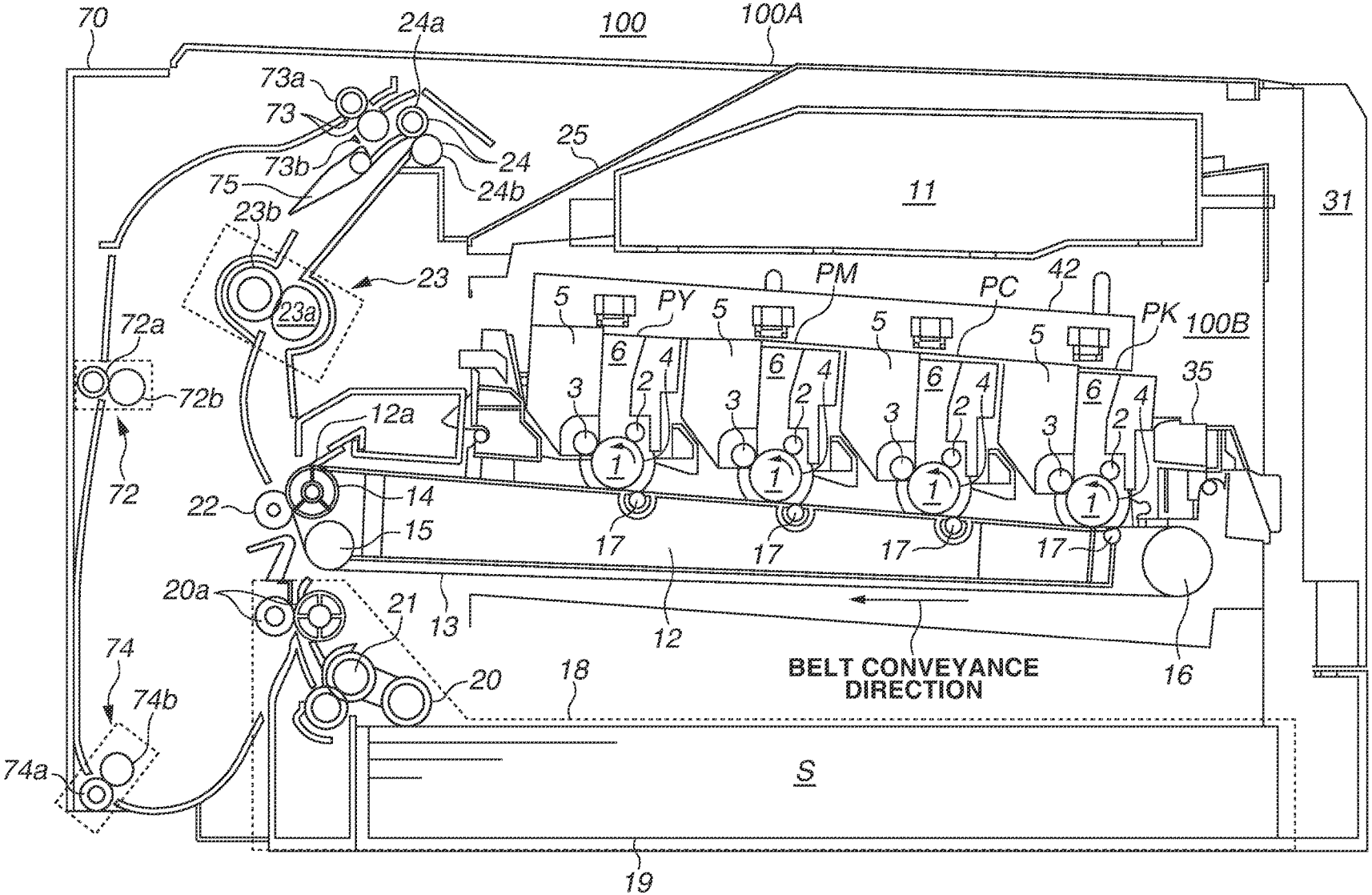
FIG. 13 is a schematic sectional view illustrating an image forming apparatus.

FIG. 13 is a sectional view illustrating an image forming apparatus 100 according to a first exemplary embodiment of the present disclosure. The image forming apparatus 100 includes four cartridges P (process cartridges), i.e., first to fourth cartridges (PY, PM, PC, and PK. The image forming apparatus 100 is a four-full-color laser printer (image forming apparatus) using an electrophotographic process. The present exemplary embodiment describes an example where a full-color image forming apparatus which uses an electrophotographic process and on which four cartridges are detachably mounted is used as the image forming apparatus 100. However, the number of cartridges to be mounted on the image forming apparatus 100 is not limited to four. The configuration of the image forming apparatus 100 can be changed, as needed. For example, the present disclosure is also applicable to an image forming apparatus that forms a monochrome image using one cartridge.

While the present exemplary embodiment described below illustrates a printer as one aspect of the image forming apparatus 100, the present exemplary embodiment is not limited to this example. For example, other types of image forming apparatuses, such as a copying machine and a facsimile apparatus, or a multi-function peripheral including a combination of these functions can be applied as the image forming apparatus 100.

In the following description, a front side (side which faces a user) of the image forming apparatus 100 is a side on which an apparatus opening/closing door (main body door) 31 is provided. A rear side (opposite side from the user) is an opposite side of the front side. A front-rear direction is a rear-to-front direction of the image forming apparatus 100 and a front-to-rear direction (rear direction) of the image forming apparatus 100. The left and right of the image forming apparatus 100 are left and right of the image forming apparatus 100 as seen from the front side of the image forming apparatus 100. A left-right direction is a right-to-left direction (leftward direction) and a direction (rightward direction) opposite to the right-to-left direction. Top and bottom sides are top and bottom sides in the gravity direction. An upward direction is a bottom-to-top direction. A downward direction is a top-to-bottom direction.

A lengthwise direction is a direction which is parallel to a rotation axis of an electrophotographic photosensitive member, which is an image bearing member on which a latent image is to be formed. A widthwise direction is a direction which is perpendicular to the lengthwise direction (perpendicular direction). One of the lengthwise ends of the photosensitive member is referred to as a drive side, and the other one of the lengthwise ends is referred to as a non-drive side. In the present exemplary embodiment, the right end in the lengthwise direction corresponds to the drive side, and the left end in the lengthwise direction corresponds to the non-drive side.

<Overall Configuration of Image Forming Apparatus>

A cartridge accommodating portion 100B is provided within an apparatus main body 100A of the image forming apparatus 100. Four cartridges, i.e., the first to fourth cartridges PY, PM, PC, and PK are arranged from the rear side toward the front side of the apparatus main body 100A in the cartridge accommodating portion 100B, and are each mounted at a predetermined mounting position (inline configuration, tandem type). Each cartridge P is pressed by a pressing unit 42, is fixed to a predetermined positioning portion of the apparatus main body 100A in the cartridge accommodating portion 100B, and is held at the predetermined mounting position. Each cartridge P is mounted at the predetermined mounting position such that a drive output portion of the apparatus main body 100A is coupled to a drive input portion of the cartridge P (not illustrated). As a result, a predetermined driving force can be transmitted to each cartridge P from a drive source of the apparatus main body 100A. Each cartridge P is mounted at the predetermined mounting position such that a power feed system of the apparatus main body 100A can be electrically connected to an electrical contact of each cartridge P and thus a bias necessary for image formation can be supplied, as needed. In the present exemplary embodiment, the mounting position of each cartridge P is a position at which the cartridge P can perform an image formation operation in the cartridge accommodating portion 100B.

Each cartridge P constitutes an image forming portion that forms an image on a recording medium S, and is detachably mounted on the apparatus main body 100A of the image forming apparatus 100. Each cartridge P includes a drum-type electrophotographic photosensitive member (hereinafter referred to as a drum) 1 serving as an image bearing member on which a latent image is to be formed. In the present exemplary embodiment, each cartridge P is a so-called integrated process cartridge that includes not only the drum 1, but also a charging unit 2, a developing unit 3, and a cleaning unit 4, each of which serves as an image formation processing unit acting on the drum 1. The first cartridge PY contains yellow (Y) toner. The second cartridge PM contains magenta (M) toner. The third cartridge PC contains cyan (C) toner. The fourth cartridge PK contains black (K) toner.

In a portion above the cartridges PY, PM, PC, and PK, a laser scanner unit 11 is provided, which is an example of an exposure unit that exposes the surface of the drum 1 of each cartridge P to light to form a latent image. The scanner unit 11 outputs laser light L that is modulated based on image information about each color, and performs scanning and exposure on the surface of the drum 1 of each cartridge P.

In a portion below the cartridges PY, PM, PC, and PK, an intermediate transfer unit 12 serving as a transfer unit (transfer member) is provided. The intermediate transfer unit 12 is opposed to the drum 1 of each cartridge P. A toner image formed on the drum 1 is primarily transferred onto the intermediate transfer unit 12, and then the toner image is secondarily transferred onto the recording medium S. The intermediate transfer unit 12 is disposed such that, for example, the intermediate transfer unit 12 contacts a frame body, which is formed of a sheet metal or the like of the apparatus main body 100A, and is positioned relative to the apparatus main body 100A with high accuracy.

The intermediate transfer unit 12 includes an endless belt 13 serving as an intermediate transfer member, a drive roller 14 that causes the endless belt 13 to move in a circulating manner, a turn roller 15, a tension roller 16, and a belt cleaning portion 12*a*. The drive roller 14 and the turn roller 15 are provided on the rear side within the apparatus main body 100A. The tension roller 16 is provided on the front side within the apparatus main body 100A. In the present exemplary embodiment, a flexible endless belt made of a dielectric material is used as the endless belt 13. The endless belt 13 is stretched over the drive roller 14, the turn roller 15, and the tension roller 16. The belt cleaning portion 12*a* is disposed on a downstream side in a conveyance direction of the endless belt 13 at a secondary transfer nip, which is described below, to be urged against the drive roller 14 through the endless belt 13.

A lower surface of each drum 1 contacts an upper surface of an upper-side belt portion of the endless belt 13 in a state where each cartridge P is mounted at the predetermined mounting position. On the inside of the endless belt 13, four primary transfer rollers 17 are provided to face the drums 1 of the cartridges P, respectively, via the upper-side belt portion. In each cartridge P, a nip portion between each drum 1 and the endless belt 13 corresponds to a primary transfer nip portion.

A secondary transfer roller 22 contacts the drive roller 14 of the intermediate transfer unit 12 via the endless belt 13. A nip portion between the secondary transfer roller 22 and the endless belt 13 corresponds to a secondary transfer nip portion.

In a portion below the intermediate transfer unit 12, a sheet feed unit 18 is provided that stores sheet-like recording media (sheet material) S onto which a toner image is to be transferred, and conveys the recording media S one by one to the intermediate transfer unit 12. The sheet feed unit 18 includes a sheet feed tray 19 on which the recording media S are stacked and accommodated, a sheet feed roller 20, a separation roller pair 21, and a registration roller pair 20*a*. The sheet feed tray 19 can be freely loaded from the front side of the apparatus main body 100A (front loading).

At an upper portion on the rear side in the apparatus main body 100A, a fixing device 23, a discharge roller pair 24, and a reverse roller pair 73 are provided. The fixing device 23 serves as a fixing unit that applies heat and pressure to each recording medium S onto which the toner image is transferred to fix the toner image on the recording medium S. The fixing device 23 includes a fixing film assembly 23*a* and a pressure roller 23*b*. The fixing film assembly 23*a* and the pressure roller 23*b* form a fixing nip N. With respect to the fixing nip N, on the side opposite to the secondary transfer nip, a reversing flapper 75 for switching a conveyance path between a single-sided printing conveyance path and a double-sided printing conveyance path is rotatably disposed. A drive mechanism (not illustrate) enables the reversing flapper 75 to move from a single-sided printing position to a double-sided printing position, thereby guiding the recording medium S to each of the single-sided printing conveyance path and the double-sided printing conveyance path. The single-sided printing conveyance path is provided to extend toward the discharge roller pair 24. The discharge roller pair 24 includes a discharge roller 24*a* and a discharge roller 24*b*. With respect to the discharge roller pair 24, on the opposite side of the single-sided printing conveyance path, a discharge tray 25 is provided on an upper surface of the apparatus main body 100A.

The double-sided printing conveyance path is provided to extend toward the reverse roller pair 73. The reverse roller pair 73 includes a reverse roller 73*a* and a reverse roller 73*b*. In single-sided printing, the discharge roller pair 24 discharges the recording medium S onto the discharge tray 25. In double-sided printing, the reverse roller pair 73 conveys the recording medium S toward the discharge tray 25, reverses the rotation direction of the reverse roller pair 73 and conveys the recording medium S to a double-sided unit 70.

The double-sided unit 70 is disposed on the main body rear side of a secondary transfer unit 80. The double-sided unit 70 includes a double-sided roller pair 72 and a sheet refeed roller pair 74 in order from the upstream side in the conveyance direction of the recording medium S. The double-sided roller pair 72 includes a double-sided roller 72*a* and a double-sided roller 72*b*. The sheet refeed roller pair 74 includes a sheet refeed roller 74*a* and a sheet refeed roller 74*b*. The double-sided roller pair 72 is configured to nip the recording medium S fed from the reverse roller pair 73 and to convey the recording medium S to the sheet refeed roller pair 74. The sheet refeed roller pair 74 is configured to nip the recording medium S fed from the double-sided roller pair 72 and to convey the recording medium to the registration roller pair 20*a*.

<Image Formation Operation>

An operation for forming a full-color image is described below. The drum 1 of each of the first to fourth cartridges PY, PM, PC, and PK is rotationally driven at a predetermined control speed in a counterclockwise direction indicated by an arrow in FIG. 13. The endless belt 13 is also rotationally driven at a speed corresponding to the speed of the drum 1 in the direction indicated by the arrow (forward direction of the rotation of the drum 1). The scanner unit 11 is separately controlled and driven.

In synchronization with this driving operation, the charging unit 2 uniformly charges the surface of the drum 1 with a predetermined polarity and potential at a predetermined control timing in each cartridge P. The scanner unit 11 performs scanning and exposure on the surface of each drum 1 with the laser light L that is modulated based on the image signal for each color. As a result, an electrostatic latent image corresponding to the image signal for the corresponding color is formed on the surface of each drum 1. The developing unit 3 develops the formed latent image into a toner image with the developer (toner) contained in a container.

In the electrophotographic image formation process operation described above, a Y-color toner image corresponding to a Y-color component of the full-color image is formed on the drum 1 of the first cartridge PY. The toner image is primarily transferred onto the endless belt 13 at a primary transfer nip portion T1 of the cartridge PY.

An M-color toner image corresponding to an M-color component of the full-color image is formed on the drum 1 of the second cartridge PM. The M-color toner image is superimposed on the Y-color toner image, which is already transferred onto the endless belt 13 at the primary transfer nip portion T1 of the second cartridge PM, and then primarily transferred onto the endless belt 13.

A C-color toner image corresponding to a C-color component of the full-color image is formed on the drum 1 of the second cartridge PM. The C-color toner image is superimposed on the (Y+M)-color toner image, which is already transferred onto the endless belt 13 at the primary transfer nip portion T1 of the third cartridge PC, and then primarily transferred onto the endless belt 13.

A K-color toner image corresponding to a K-color component of the full-color image is formed on the drum 1 of the fourth cartridge PK. The K-color toner image is superimposed on the (Y+M+C)-color toner image, which is already transferred onto the endless belt 13 at the primary transfer nip portion T1 of the second cartridge PM, and then primarily transferred onto the endless belt 13.

Thus, unfixed toner images of four colors, i.e., Y-color+M-color+C-color+K-color, which are sequentially transferred onto the endless belt 13 and superimposed, are formed. In each cartridge P, transfer residual toner that remains on the surface of each drum 1 after the toner image is primarily transferred onto the endless belt 13 is removed by the cleaning unit 4.

A sheet feed motor (not illustrated) is driven at a predetermined control timing. A driving force from the sheet feed motor enables the sheet feed roller 20 and the separation roller pair 21 to separate and feed the recording media S stacked on the sheet feed tray 19 one by one and feed the recording media S to the registration roller pair 20*a*. Thus, the registration roller pair 20*a* guides the recording media S into the secondary transfer nip portion. At the secondary transfer nip, a secondary transfer bias for transferring the toner image formed on the endless belt 13 onto each of the recording media S is supplied from a power supply unit (not illustrated). The recording media S are nipped by the endless belt 13 and the secondary transfer roller 22 and are conveyed at a speed corresponding to the conveyance speed of the endless belt 13. As a result, in the process in which the recording media S are nipped and conveyed in the secondary transfer nip portion, the four-color superimposed toner images on the endless belt 13 are sequentially and collectively transferred onto the surface of each of the recording media S.

On the other hand, residual toner that has not been transferred onto the recording media S remains on the endless belt 13 after the toner images are transferred. The cleaning portion 12*a* slides on the endless belt 13 and removes and collects the residual toner from the surface of the endless belt 13. This prevents the residual toner from being transferred onto the subsequent recording medium S.

Each recording medium S is separated from the surface of the endless belt 13 and guided to the fixing device 23 through the conveyance path, and then heated and pressed at the fixing nip N. Thus, the toner images of the respective colors are mixed and fixed on the recording medium S.

In the configuration according to the present exemplary embodiment, the image forming apparatus 100 is capable of performing double-sided printing. A single-sided printing operation and a double-sided printing operation will be described below.

Figure 1A:
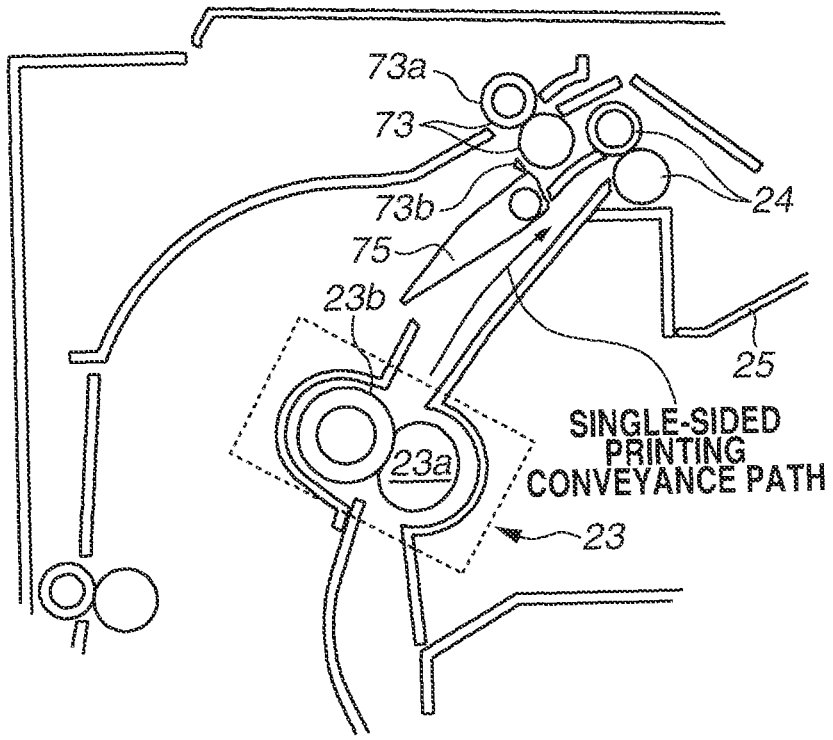
FIG. 1A is a schematic sectional view illustrating a fixing unit during single-sided printing.

In the case of single-sided printing (FIG. 1A), the recording medium S passes through the fixing device 23 and is discharged by the discharge roller pair 24 onto the discharge tray 25 as a full-color image formed product.

Figure 1B:
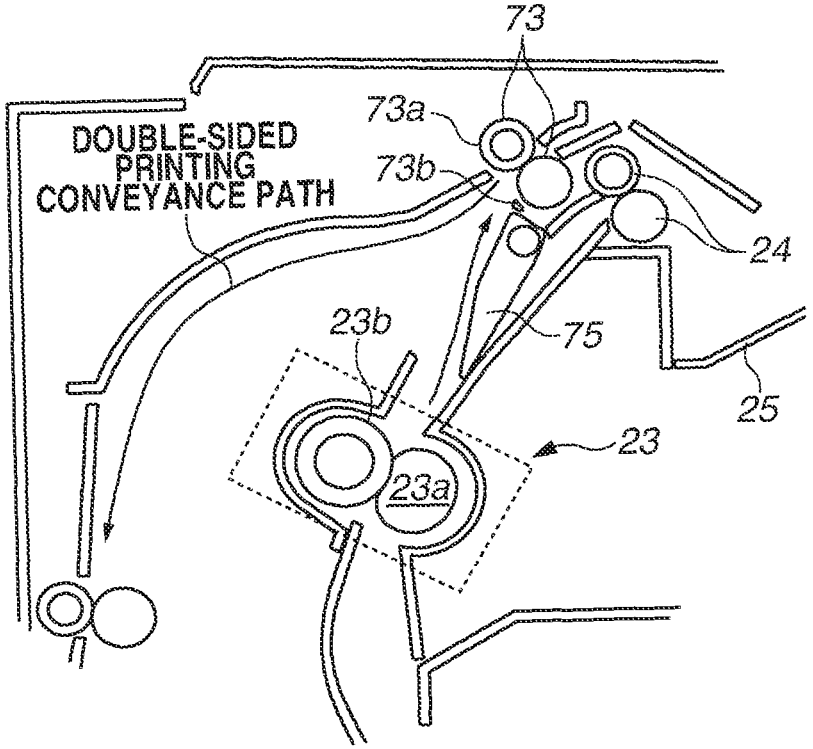
FIG. 1B is a schematic sectional view illustrating the fixing unit during double-sided printing.

In the case of double-sided printing (FIG. 1B), after the recording medium S has passed through the fixing device 23, the reversing flapper 75 is rotated by a drive mechanism (not illustrated) and is conveyed to the reverse roller pair 73. At this time, the reverse roller pair 73 is rotated in a direction in which the recording medium S is conveyed to the discharge tray 25, and nips and conveys the recording medium S toward the discharge tray 25. After a trailing edge of the recording medium S has passed through the fixing nip N and then passed through the reversing flapper 75, the reverse roller pair 73 reverses the rotation direction and conveys the recording medium S toward the double-sided unit 70. After that, the recording medium S is sequentially nipped and conveyed by the double-sided roller pair 72 and the sheet refeed roller pair 74, and then conveyed to the registration roller pair 20*a*. The recording medium S nipped by the registration roller pair 20*a* is guided into the secondary transfer nip portion again at a predetermined timing to match the toner images on the endless belt 13. After that, like in the case of single-sided printing, the toner images on the endless belt 13 are transferred onto the recording medium S and the recording medium S is sequentially conveyed from the fixing nip N to the discharge roller pair 24, and then discharged onto the discharge tray 25 by the discharge roller pair 24 as a full-color image formed product on which double-sided printing is performed.

DETAILED DESCRIPTION OF CHARACTERISTIC CONFIGURATION OF PRESENT EXEMPLARY EMBODIMENT

<Details of Secondary Transfer Unit>

A configuration for positioning the secondary transfer unit 80 (opening/closing unit) in the apparatus main body 100A will be described in detail below.

Figure 2A:
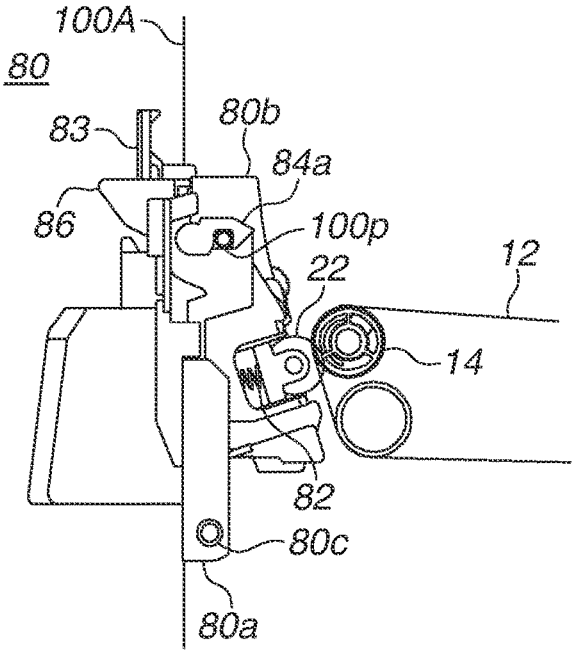
FIGS. 2A to 2C are sectional views each illustrating a configuration of a secondary transfer unit.
Figure 2B:
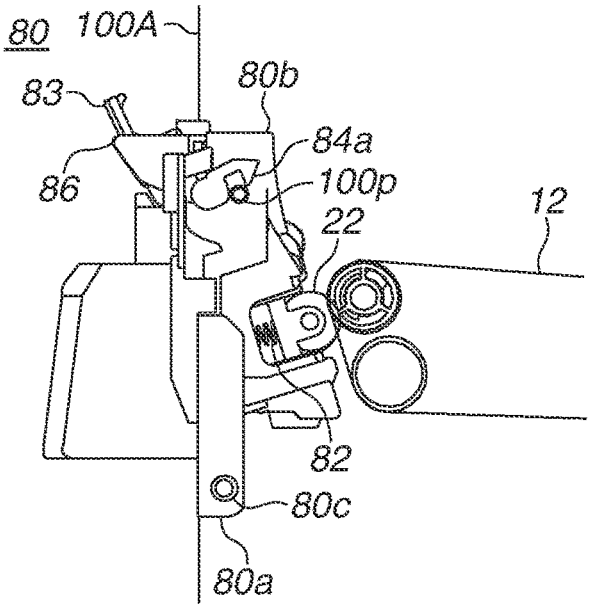
Figure 2C:
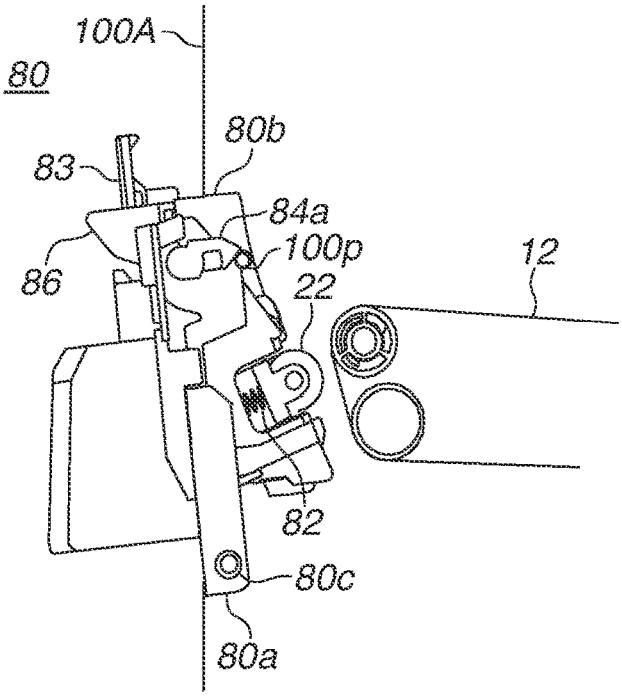

FIGS. 2A to 2C each illustrate a configuration in the vicinity of the secondary transfer unit 80. FIG. 2A illustrates a state where the secondary transfer unit 80 is positioned within the apparatus main body 100A. FIG. 2B illustrates a state where a handle 83 is rotated to disengage a lock engaging portion 84*a* from a portion to be engaged 100*p* of the apparatus main body 100A. FIG. 2C illustrates a state where the lock engaging portion 84*a* contacts the portion to be engaged 100*p* of the apparatus main body 100A in the process in which the secondary transfer unit 80 is switched from an opened state to a closed state.

The secondary transfer unit 80 is held by a secondary transfer unit shaft 80*c* in such a manner that the secondary transfer unit 80 is rotatable relative to the apparatus main body 100A. In the present exemplary embodiment, the secondary transfer unit shaft 80*c* is a metal shaft that is attached to a secondary transfer frame 80*a*, which is made of a sheet metal, and is configured to be inserted into a hole (not illustrated) formed in the apparatus main body 100A and to be rotatable. The secondary transfer frame 80*a* includes a secondary transfer conveyance guide 80*b*, which is fixed to the secondary transfer frame 80*a*, the secondary transfer roller 22, bearings 81, which rotatably hold the shaft of the secondary transfer roller 22, and secondary transfer springs 82 that urge the pair of right and left bearings 81, respectively. The secondary transfer conveyance guide 80*b* is provided such that the recording medium S is guided at least either before or after the recording medium S passes through the secondary transfer nip. Each of the secondary transfer springs 82 is provided between the secondary transfer frame 80*a* having rigidity and the corresponding bearing 81, and urges the bearing 81 that is movable in an expansion/contraction direction of the secondary transfer spring 82. Thus, the secondary transfer roller 22 is provided such that the secondary transfer nip portion is formed between the secondary transfer roller 22 and the drive roller 14 (intermediate transfer unit 12) via the endless belt 13.

Further, the secondary transfer unit 80 is provided with a secondary transfer lock mechanism 84. The secondary transfer lock mechanism 84 includes lock engaging portions 84*a* (a first engaging portion and a second engaging portion) that are rotatable relative to the secondary transfer unit 80. The lock engaging portions 84*a* respectively engage with the portions to be engaged 100*p* (a first portion to be engaged and a second portion to be engaged), which are provided in the apparatus main body 100A, thereby regulating the rotation of the secondary transfer unit 80 relative to the apparatus main body 100A. In other words, the secondary transfer unit 80 is configured to take a closed position (first closed position) where the recording material S on which an image is formed is conveyed and a conveyance path including the secondary transfer nip portion is formed, and take an open position (first open position) where the conveyance path is opened.

As described above, since the secondary transfer roller 22 and the drive roller 14 form the secondary transfer nip, the secondary transfer unit 80 may be desirably positioned relative to the intermediate transfer unit 12 with high accuracy. On the other hand, the intermediate transfer unit 12 is positioned relative to the apparatus main body 100A and the drive roller 14 is positioned relative to the apparatus main body 100A. Thus, the secondary transfer unit 80 is positioned relative to the apparatus main body 100A with high accuracy, so that a positional deviation from the intermediate transfer unit 12 can be prevented.

Figure 3:
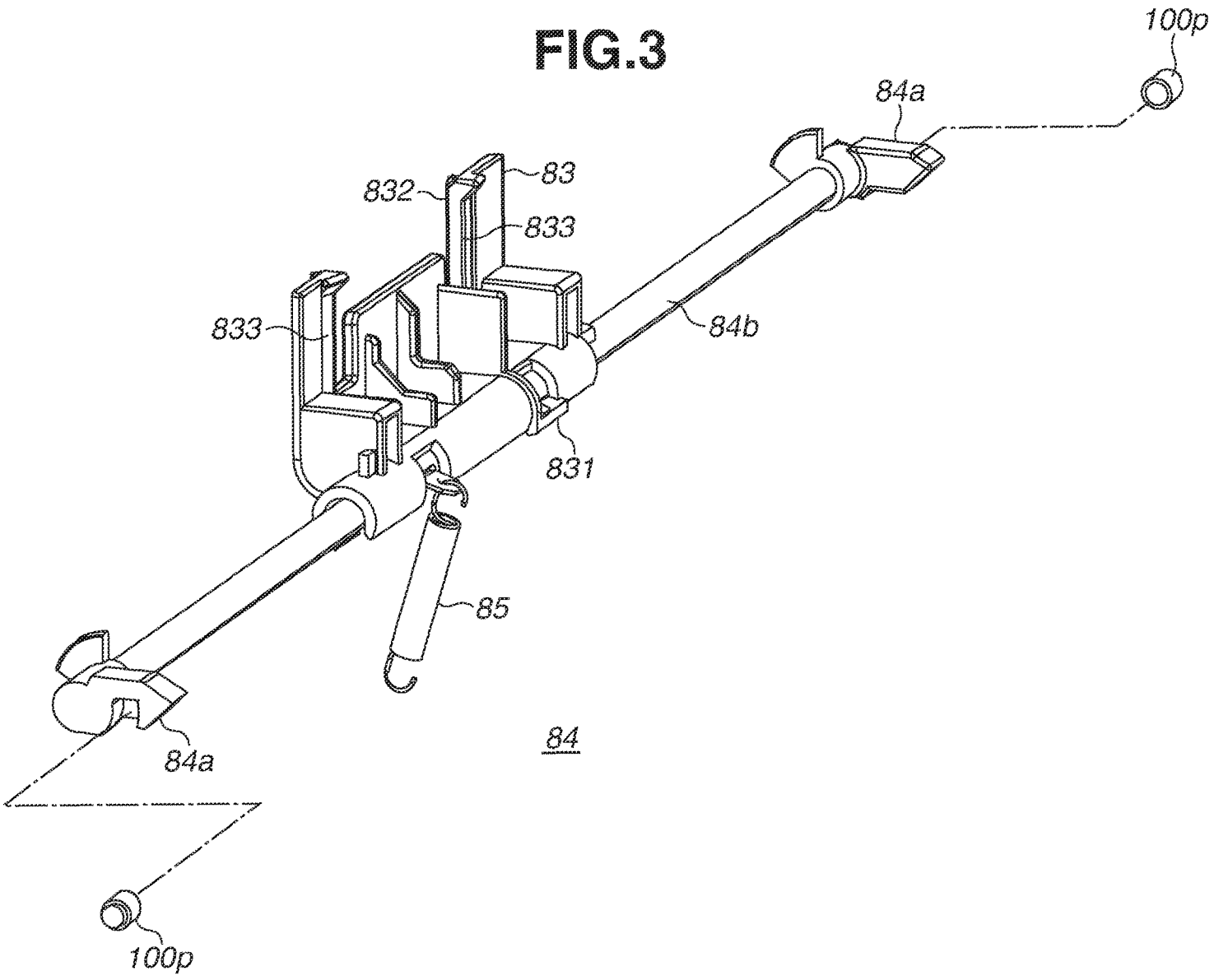
FIG. 3 is a perspective view illustrating a secondary transfer lock mechanism.

The secondary transfer lock mechanism 84 will be described in detail below. FIG. 3 is a perspective view illustrating the secondary transfer lock mechanism 84. The secondary transfer lock mechanism 84 includes the lock engaging portions 84*a* that engage with the portions to be engaged 100*p*, which are provided in the apparatus main body 100A, and a lock shaft 84*b* (interlock shaft). The lock engaging portions 84*a* are respectively provided at one end and the other end of the lock shaft 84*b*.

The lock engaging portions 84*a* are respectively provided at one end and the other end in the axial direction (rotation axial direction) of the secondary transfer unit shaft 80*c*, and are coupled with the lock shaft 84*b* and configured to be integrally movable. The lock shaft 84*b* is held on the secondary transfer unit 80 in such a manner that the lock shaft 84*b* is rotatable in the axial direction as the rotational axis. The lock shaft 84*b* and the lock engaging portions 84*a* are positioned in any direction perpendicular to the axial direction of the lock shaft 84*b*. The lock shaft 84*b* is connected with a lock urging member 85 such that a rotation moment is supplied to the lock shaft 84*b*. Thus, the lock engaging portions 84*a* engage with the portions to be engaged 100*p*, respectively, which are provided in the apparatus main body 100A, by an urging force of the lock urging member 85. In other words, when the lock engaging portions 84*a* are positioned at positions where the lock engaging portion 84*a* can engage with the portions to be engaged 100*p*, the lock engaging portions 84*a* are configured to engage by a rotational moment and hold the engaging state. On the other hand, the secondary transfer unit 80 is provided with the handle 83 (gripping portion) that is fixed such that the handle 83 can be rotated coaxially with the rotation axis of the lock shaft 84*b* to release the engagement of the lock engaging portions 84*a* with the portions to be engaged 100*p*. Thus, the handle 83 can rotate the lock shaft 84*b* against the urging force of the lock urging member 85.

As the lock shaft 84*b*, for example, a metal pipe having high rigidity is used. Accordingly, the lock shaft 84*b* is not deformed due to a reaction force from the secondary transfer spring 82, and the lock engaging portions 84*a* can reliably engage with the portions to be engaged 100*p*. Thus, the secondary transfer unit 80 can be locked relative to the apparatus main body 100A. In addition, the lock shaft 84*b* has high torsional rigidity, and thus when one of the right and left lock engaging portions 84*a* moves, the other one of the right and left lock engaging portions 84*a* synchronously moves without any delay.

A case where the secondary transfer unit 80 is caused to transition from the closed position to the open position relative to the apparatus main body 100A will be described below.

Figure 4A:
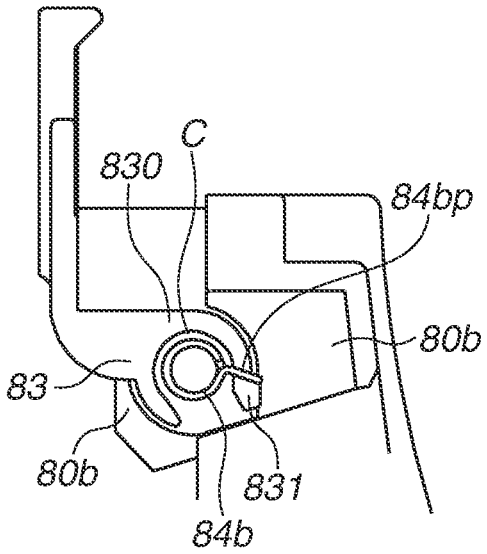
FIGS. 4A to 4C are sectional views each illustrating a configuration of a handle.
Figure 4B:
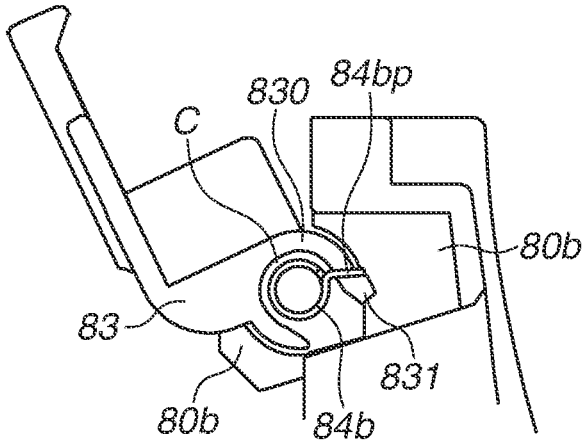
Figure 4C:
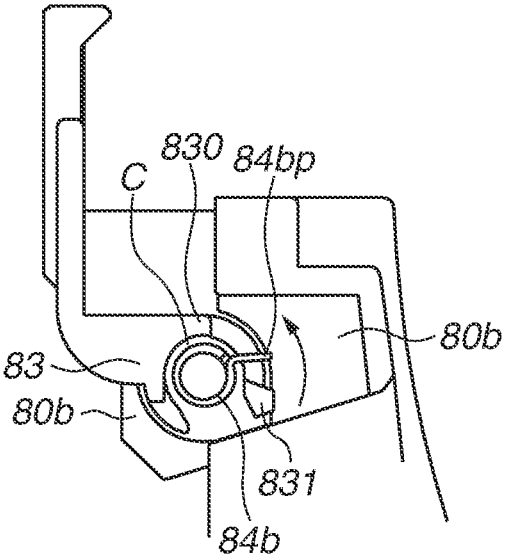

FIGS. 4A to 4C are sectional views each illustrating the handle 83. The handle 83 includes a bearing portion 830 with a gap C formed between the bearing portion 830 and the lock shaft 84*b*, and a contact portion 831 that protrudes from a part of the bearing portion 830 toward one end in the axial direction of the lock shaft 84*b*. The handle 83 is disposed also with the gap C relative to the secondary transfer conveyance guide 80*b*, and the bearing portion 830 is configured to slide relative to the lock shaft 84*b* and to rotate within a certain range without interfering with the secondary transfer conveyance guide 80*b*.

The handle 83 is rotated in a direction indicated by an arrow in FIG. 4C to engage with a lock shaft protruding portion 84*bp*, which is provided to protrude from the lock shaft 84*b*, thereby enabling the lock shaft 84*b* to rotate in the rotation direction of the handle 83. In addition, since the lock shaft 84*b* operates integrally with the lock engaging portions 84*a*, the lock engaging portions 84*a* also rotate in the same direction. In other words, the handle 83 is rotated to release the engagement of the lock engaging portions 84*a* with the portions to be engaged 100*p* (FIG. 2B). In this manner, the user operates the handle 83 so that the secondary transfer unit 80 can be released from the apparatus main body 100A, and the user directly grips the handle 83 to rotate the secondary transfer unit 80 to enable the secondary transfer unit 80 to transition from the closed position to the open position.

Next, a case will be described where the secondary transfer unit 80 is caused to transition from the open position to the closed position.

In the secondary transfer unit 80 at the open position, the lock engaging portions 84*a* are integrally rotated with the lock shaft 84*b*. Accordingly, the lock engaging portions 84*a* are positioned at the predetermined position due to the urging force of the lock urging member 85. Specifically, the handle 83 contacts the secondary transfer conveyance guide 80*b* (FIG. 4A), thereby regulating the movement of the handle 83. As a result, the lock shaft 84*b* can be rotated due to the urging force of the lock urging member 85 at an angle within a predetermined range, and the lock engaging portions 84*a* of the secondary transfer unit 80 in the open state are positioned at the predetermined position.

When the secondary transfer unit 80 in the open state is gradually closed, the leading end of each of the lock engaging portions 84*a* contacts the corresponding portion to be engaged 100*p*. The state is illustrated in FIG. 2C. When the secondary transfer unit 80 is further closed, the lock engaging portions 84*a* are rotated against an elastic force of the lock urging member 85 while an inclined surface at the leading end of each of the lock engaging portions 84*a* slides on the corresponding portion to be engaged 100*p*. Then, when the lock engaging portions 84*a* reach the predetermined position, the lock engaging portions 84*a* engage with the portions to be engaged 100*p* due to the elastic force of the lock urging member 85. Thus, when the lock engaging portions 84*a* and the lock shaft 84*b* are gradually rotated, the portion 84*bp* protruding from the lock shaft 84*b* is separated from the contact portion 831 provided on the handle 83 without engaging with the contact portion 831 (FIG. 4C).

Accordingly, the rotation operation of the lock engaging portion 84*a* as well as the lock shaft 84*b* is not performed synchronously with the handle 83, and thus there is no effect on the operation. Therefore, even if the user presses the handle 83 to close the secondary transfer unit 80 when the secondary transfer unit 80 is closed, there is no effect on a series of lock operations.

The handle 83 serving as an unlock mechanism as described above is disposed in the vicinity of the lock shaft 84*b* coaxially with the lock shaft 84*b*, thereby eliminating the need to provide separate rotational centers and to provide a mechanism for operating the rotational centers in synchronization with each other. Therefore, an excellent space efficiency in arrangement of the handle 83 and the lock shaft 84*b* is obtained.

A one-sided tightening prevention function using the lock mechanism according to the present exemplary embodiment will be described below.

In the present exemplary embodiment, unit engaging portions (lock engaging portions 84*a*) are provided on the right and left sides, respectively. Conventionally, in a configuration in which a plurality of engaging portions is positioned at separate positions, a state where any one of the engaging portions cannot be locked may occur due to deformation of the unit, a positional tolerance, or the like when the user presses an end of the unit. If such a phenomenon occurs, it is difficult to discern whether or not the unit is accurately positioned relative to the apparatus main body 100A. If the printing operation is carried out in such a state, a malfunction or failure such as paper jam may occur. However, the configuration according to the present exemplary embodiment can avoid the occurrence of the phenomenon in which "some of a plurality of unit engaging portions cannot be accurately locked (hereinafter referred to as "one-sided tightening")", by the right and left lock engaging portions 84*a*. The lock engaging portions 84*a* operate interlocking with the lock shaft 84*b*. The principle of one-sided tightening will be described below.

Figure 5A:
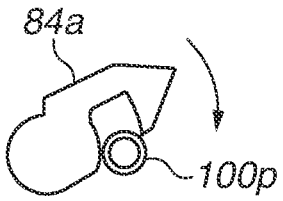
FIGS. 5A and 5B illustrate states of the secondary transfer lock mechanism at its one end and the other end, respectively.
Figure 5A:
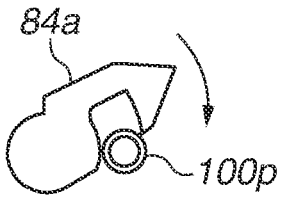

A substantially central portion of the secondary transfer unit 80 is pressed to cause the secondary transfer unit 80 to move straight into the apparatus main body 100A, thereby making it possible to simultaneously lock the right and left lock engaging portions 84 and to position the secondary transfer unit 80 relative to the apparatus main body 100A. In this case, as illustrated in FIG. 5A, when the lock engaging portion 84*a* at one end reaches a position where the lock engaging portion 84*a* can engage with the corresponding portion to be engaged 100*p*, the lock engaging portion 84*a* on the other end is also positioned at a position where the lock engaging portion 84*a* can engage with the corresponding portion to be engaged 100*p*, so that the right and left lock engaging portions 84*a* are rotated in a direction indicated by an arrow in FIG. 5A. As a result, the secondary transfer unit 80 is locked relative to the apparatus main body 100A.

Figure 5B:
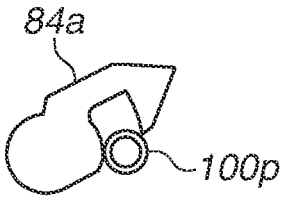
Figure 5B:
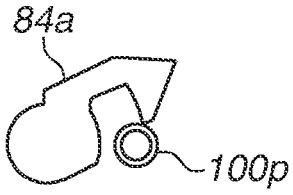

On the other hand, as a result of an operation, such as pressing in the vicinity of the right and left ends of the secondary transfer unit 80, the secondary transfer unit 80 may obliquely enter the apparatus main body 100A. In this case, as illustrated in FIG. 5B, when the lock engaging portion 84*a* at one end reaches the position where the lock engaging portion 84*a* can engage with the corresponding portion to be engaged 100*p*, the lock engaging portion 84*a* at the other end may not reach the position where the lock engaging portion 84*a* can engage with the corresponding portion to be engaged 100*p* in some cases. In such a situation, according to the present exemplary embodiment, if the lock engaging portion 84*a* at the other end is not positioned at the position where the lock engaging portion 84*a* can engage with the corresponding portion to be engaged 100*p*, the lock engaging portion 84*a* at the other end cannot be rotated, and also the lock engaging portion 84*a* at one end that is coupled with the lock shaft 84*b* cannot be rotated. Accordingly, the secondary transfer unit 80 is not locked relative to the apparatus main body 100A. In other words, unless the lock engaging portions 84*a* at both sides are positioned at the positions where the lock engaging portions 84*a* can simultaneously engage with the portions to be engaged 100*p*, respectively, the lock engaging portions 84*a* and the portions to be engaged 100*p* do not engage with each other, so that one-sided tightening does not occur. If the secondary transfer unit 80 is not locked relative to the apparatus main body 100A, the secondary transfer unit 80 is returned to the open position due to the reaction force of the urging force acting on the intermediate transfer unit 12 or by its own weight. Therefore, the user can recognize the unlocked state. Consequently, it is possible to prevent a malfunction from occurring.

<Details of Double-Sided Unit>

Figure 6A:
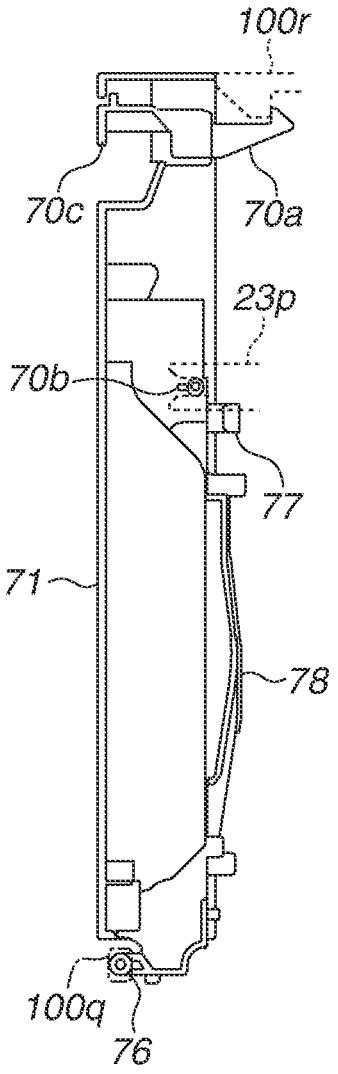
FIGS. 6A to 6C are sectional views each illustrating a configuration of a double-sided unit.
Figure 6B:
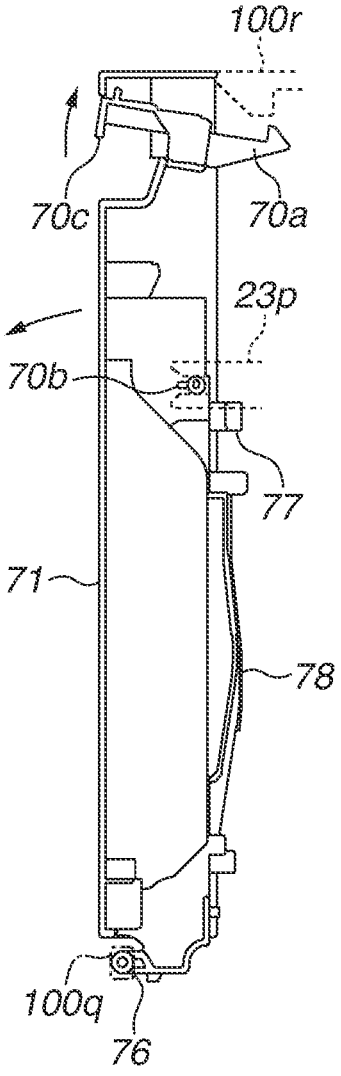
Figure 6C:
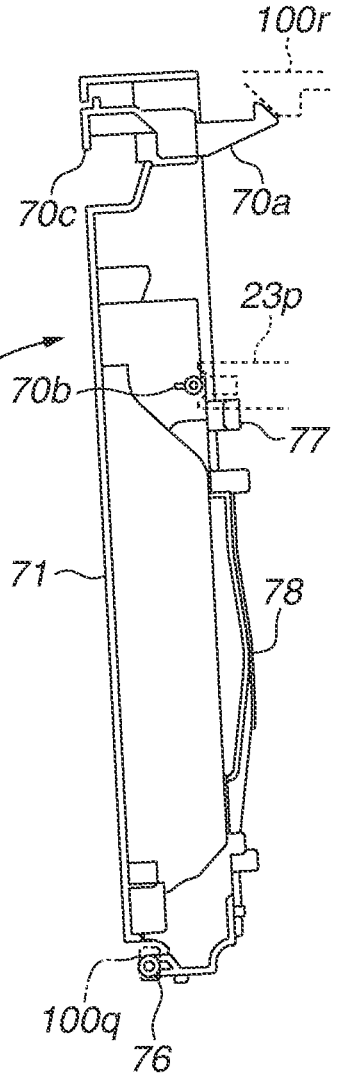

The double-sided unit 70 (opening/closing member) will be described in detail below. FIGS. 6A to 6C are sectional views each illustrating the double-sided unit 70.

The double-sided unit 70 includes a double-sided door 71 that is rotatable around a double-sided unit shaft 76 engaging with a hole 100*q* which is provided in the apparatus main body 100A. The hole 100*q* is fit to the double-sided unit shaft 76 in the front-rear direction without looseness. The hole 100*q* is an oval hole having a clearance in the top-bottom direction. The double-sided unit 70, i.e., the double-sided door 71 is positioned in the front-rear direction by the double-sided unit shaft 76 inserted into the hole 100*q* and is temporarily held with a degree of freedom in the top-bottom direction. Further, the double-sided unit 70 includes a double-sided lock portion 70*a* and a double-sided engagement shaft 70*b*.

The double-sided lock portion 70*a* is rotatably attached to the double-sided door 71 and is urged in a closing direction by a spring (not illustrated). The double-sided lock portion 70*a* has a hook-shape leading end. The hook shape is positioned by hanging on a portion to be engaged 100*r* which is provided within the apparatus main body 100A. The double-sided door 71 is locked relative to the apparatus main body 100A at a closed position (second closed position) where a double-sided conveyance path is formed. At the time, the double-sided unit 70, i.e., the double-sided door 71 is positioned at the position where the opening in the apparatus main body 100A through which the secondary transfer unit 80 is exposed is covered. In the present exemplary embodiment, the double-sided lock portion 70*a* is integrally formed with a double-sided handle 70*c* that is attached to the double-sided door 71. When the double-sided unit 70 is locked at the closed position of the apparatus main body 100A, the user grips the double-sided handle 70*c* to rotate the double-sided lock portion 70*a*. Through the operation, the locked state can be released to enable movement of the double-sided unit 70 to an open position (second open position) where the double-sided conveyance path is opened (FIG. 6B). When the double-sided unit 70, i.e., the double-sided door 71 is positioned at the open position, the opening of the apparatus main body 100A is opened, and the secondary transfer unit 80 is exposed from the opening. Further, when the double-sided unit 70 is closed from the open position, the double-sided door 71 is pressed and rotated (FIG. 6C) so that a slope provided at the leading end of the double-sided locking unit 701 contacts a slope provided at the leading end of the portion to be engaged 100*r* and slides on the slope. Thus, the double-sided lock portion 70*a* is moved to rotate to a predetermined position where the hook shape of the double-sided lock portion 70*a* and the hook shape of the portion to be engaged 100*r* engage with each other, thereby making it possible to bring the double-sided door 71 into the closed state relative to the apparatus main body 100A.

The double-sided engagement shaft 70*b* is a shaft that extends in parallel to the double-sided unit shaft 76 and engages with a double-sided portion to be engaged 23*p* which is provided in the fixing unit of the apparatus main body 100A. The double-sided portion to be engaged 23*p* has a groove shape that is fit to the double-sided engagement shaft 70*b* in the top-bottom direction of the apparatus main body 100A, and the top-bottom direction of the double-sided unit 70 is positioned relative to the fixing unit 23. In this manner, an upper portion of the double-sided unit 70 is positioned relative to the fixing device 23, which makes it possible to accurately receive and convey the recording media S fed from the fixing device 23.

<Door Opening/Closing Synchronous Operation During Jam Processing>

If a jam of the recording media S has occurred during the image formation operation, the user opens the double-sided unit 70 to take out the recording media S from the apparatus main body 100A, thereby making it possible to access the double-sided printing conveyance path in the apparatus main body 100A to remove the recording media S. Then, the user further opens the secondary transfer unit 80 from the state where the double-sided unit 70 is opened, thereby making it possible to access the conveyance path leading from the registration roller portion to the secondary transfer portion and leading from the secondary transfer portion to the fixing portion to remove the recording media S.

In this case, the user grips and pulls the double-sided handle 70*c* of the double-sided door 71, which is positioned at the outermost side, thereby making it possible to synchronously rotate the double-sided lock portion 70*a* to release the locked state and to open the double-sided unit 70. In the present exemplary embodiment, the secondary transfer unit 80 can also be opened synchronously with this operation. This operation will be described in detail below.

(Door Synchronous Opening Operation)

Figure 7A:
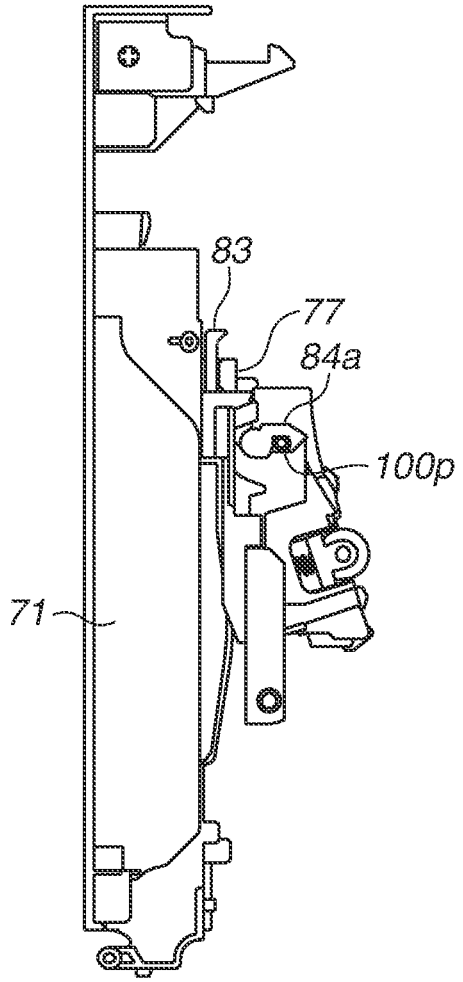
FIGS. 7A and 7B each illustrate an interlocking operation between the double-sided unit and the secondary transfer unit (closed state).
Figure 7B:
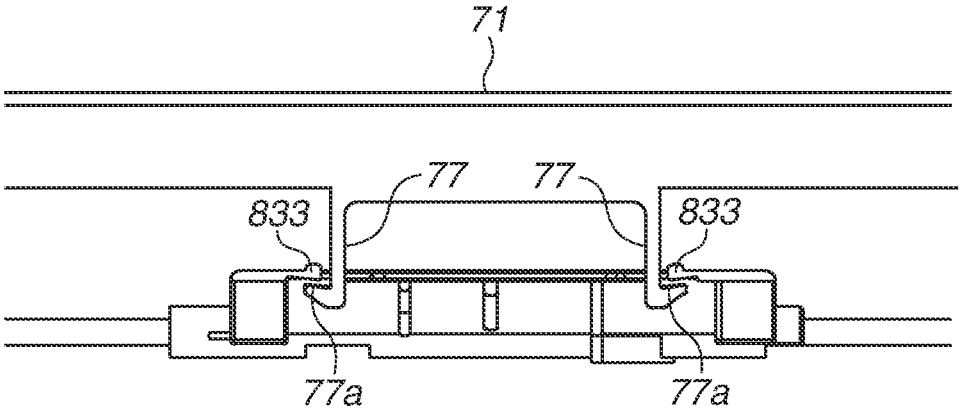
Figure 8A:
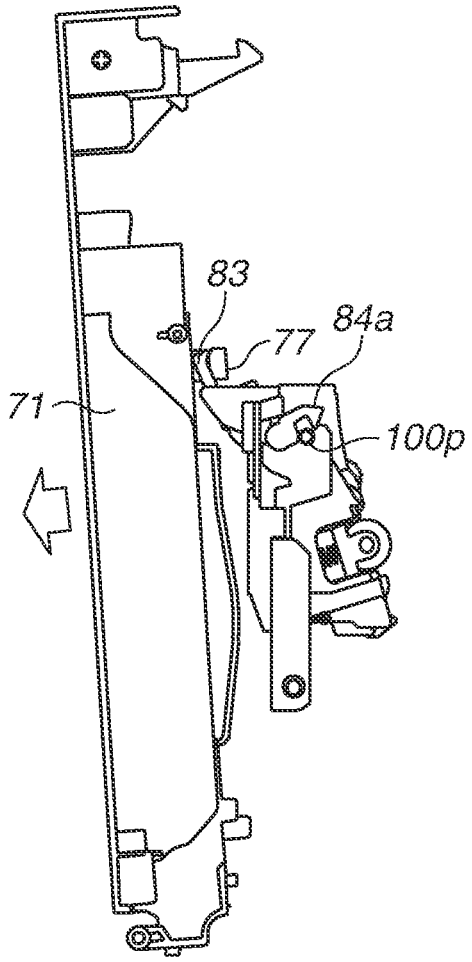
FIGS. 8A and 8B each illustrate the interlocking operation (closed state) between the double-sided unit and the secondary transfer unit (unlocked state).
Figure 8B:
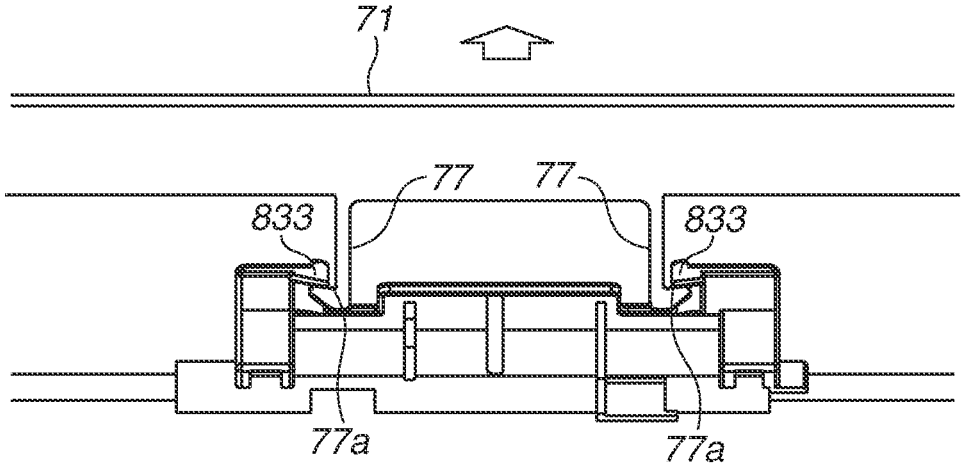

FIG. 7A is a side view illustrating a state where the double-sided unit 70 and the secondary transfer unit 80 are each positioned at the closed position. FIG. 7B is a sectional view as seen from the top. The double-sided unit 70 is provided with hook portions 77. Each hook portion 77 includes a hook engaging portion 77*a*. When both the double-sided unit 70 and the secondary transfer unit 80 are positioned at the closed position, the hook engaging portion 77*a* is disposed so as to engage with a portion 833 to be engaged, which is provided in the handle 83, so that each hook portion 77 faces the handle 83 provided on the secondary transfer unit 80. When the double-sided unit 70 is unlocked and rotated, the hook engaging portion 77*a* engages with the portion 833 to be engaged and rotates the handle 83. Then, when the handle 83 is rotated by a predetermined amount, the lock engaging portions 84*a* which are synchronously rotated are disengaged from the portions to be engaged 100*p*, thereby enabling the secondary transfer unit 80 to perform the rotation operation (FIGS. 8A and 8B). The secondary transfer unit 80 receives the reaction force of the urging force acting on the intermediate transfer unit 12, and is rotated to the open side. After the secondary transfer unit 80 is separated from the intermediate transfer unit 12, the secondary transfer unit 80 is further rotated to the open side by its own weight. Accordingly, the secondary transfer unit 80 contacts the double-sided unit 70 and is opened in accordance with the opening operation. By the above-described operation, when the double-sided unit 70 is opened, two doors can be positioned together at the open position synchronously with the secondary transfer unit 80.

With this configuration, by one operation, the user can access the recording media S jammed in the double-sided conveyance path and in the conveyance path leading from the registration roller portion to the secondary transfer portion and leading from the secondary transfer portion to the fixing portion, which improves apparatus usability.

In particular, in the present exemplary embodiment, the gap C is provided between the lock shaft 84*b* and the bearing portion 830 of the handle 83 that is rotated to release the engagement of the lock engaging portions 84*a* with the portions to be engaged 100*p*.

The hook portion 77 is fixed to the double-sided door 71 constituting the double-sided unit 70, and the double-sided door 71 is fixed with the hook portions 77 in the apparatus main body 100A, thereby forming the double-sided printing conveyance path through which the recording media S pass. When the double-sided unit 70 is positioned at the closed position where the double-sided printing conveyance path is formed in the apparatus main body 100A, the rotational center of the double-sided unit 70 is positioned in the front-rear direction, while the position of the double-sided unit 70 in the top-bottom direction is determined with a degree of freedom. Further, the double-sided unit 70, i.e., the double-sided door 71 can be distorted or deformed. Accordingly, the hook portions 77 integrally formed with the double-sided door 71 are also positioned in the front-rear direction, while the position of each of the hook portions 77 in the top-bottom direction is determined with a degree of freedom. When the double-sided door 71 is opened or closed, the hook portions 77 may be slightly displaced from a predetermined movement locus.

Thus, in a configuration in which the handle 83 does not include the gap C relative to the bearing portion 830 and the handle 83 is integrally formed with the bearing portion 830, when the hook portions 77 are displaced from the predetermined movement locus and the hook portions 77 contact the handle 83, the handle 83 cannot move on the basis of the position of each of the hook portions 77. As a result, there is a possibility that the hook portions 77 cannot fully engage with the handle 83 and the secondary transfer unit 80 cannot be opened synchronously with the opening operation of the double-sided unit 70. There is another possibility that the hook portions 77 may engage with the handle 83 with a strong force and the handle 83 or one of the hook portions 77 may be damaged when the secondary transfer unit 80 is also opened synchronously with the opening operation of the double-sided unit 70.

However, according to the present exemplary embodiment, the gap Cis provided between the lock shaft 84*b* and the bearing portion 830 of the handle 83, and the handle 83 can be moved by the amount corresponding to the gap C between the bearing portion 830 and the lock shaft 84*b* in the direction perpendicular to the lock shaft 84*b*. With this configuration, if the hook portions 77 move in a direction deviating from the predetermined movement locus and contact the handle 83, the handle 83 can be moved on the basis of the position of each of the hook portions 77. More specifically, the orientation of the handle 83 can be changed so that one of the hook portions 77 and the other one of the hook portions 77 sequentially contact the handle 83, thereby bringing the handle 83, and the hook portions 77, which are positioned at one end and the other end respectively, into a predetermined contact state. As a result, the hook portions 77 can engage with the handle 83 with a force within a predetermined range, and the secondary transfer unit 80 can be stably opened synchronously with the opening operation of the double-sided unit 70.

The handle 83 is disposed with the gap C formed relative to the secondary transfer conveyance guide 80*b*, and the handle 83 is configured to move on the basis of the position of each of the hook portions 77 without interfering with the secondary transfer conveyance guide 80*b*, so that advantageous effects of the present disclosure can be obtained.

(Synchronous Door Closing Operation)

After finishing the jam processing, the user needs to close the two doors to be ready for image formation. In this case, in the configuration according to the present exemplary embodiment, the secondary transfer unit 80 can also be closed synchronously with the closing operation of the double-sided unit 70. The outline of this operation will be described below.

Figure 10:
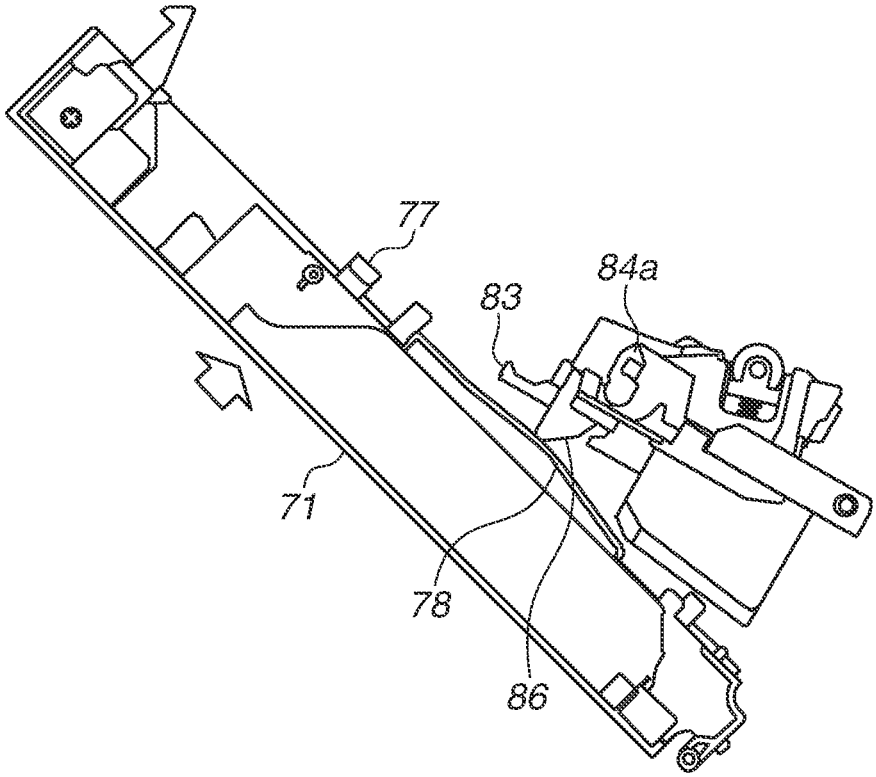
FIG. 10 illustrates the interlocking operation between the double-sided unit and the secondary transfer unit (during a rail portion sliding operation).

When the closing operation of the double-sided unit 70 is started, as illustrated in FIG. 10, the double-sided unit 70 gradually closes synchronously with the operation, while a synchronous protruding portion 86 of the secondary transfer unit 80 contacts a rail portion 78, which is provided on the double-sided unit 70, and slides on the rail portion 78. When the closing operation is further continued, a slope-shaped hook contact portion 77*b*, which is positioned at the leading end of each hook portion 77, contacts a portion 832 to be contacted, provided on the handle 83, and the rail portion 78 and the synchronous protruding portion 86 are separated from each other. When the closing operation is further continued, the lock engaging portions 84*a* within the secondary transfer unit 80 contact the portions to be engaged 100*p*, and slide on them and the lock engaging portion 84*a* is rotated. In this case, although the handle 83 contacts the hook portions 77, the handle 83 rotates the lock engaging portions 84*a* without causing any effect on the rotation operation of the lock engaging portions 84*a*.

Figure 9A:
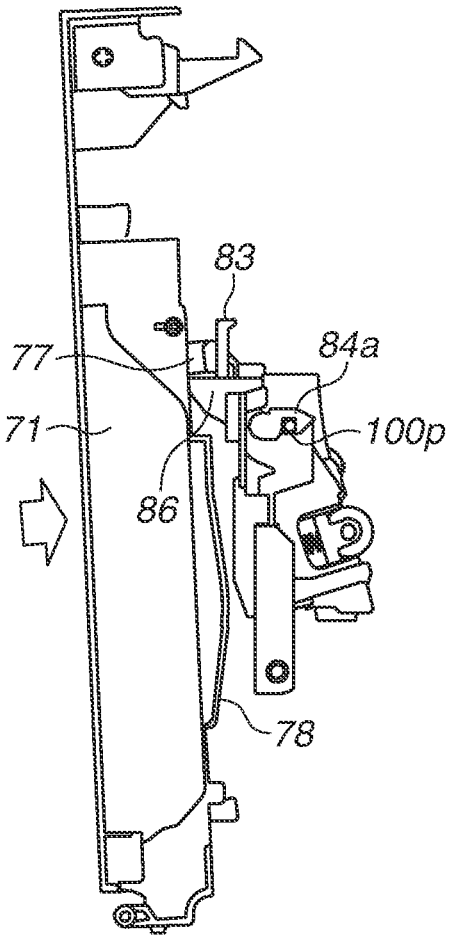
FIGS. 9A and 9B each illustrate the interlocking operation between the double-sided unit and the secondary transfer unit (during a handle urging operation).
Figure 9B:
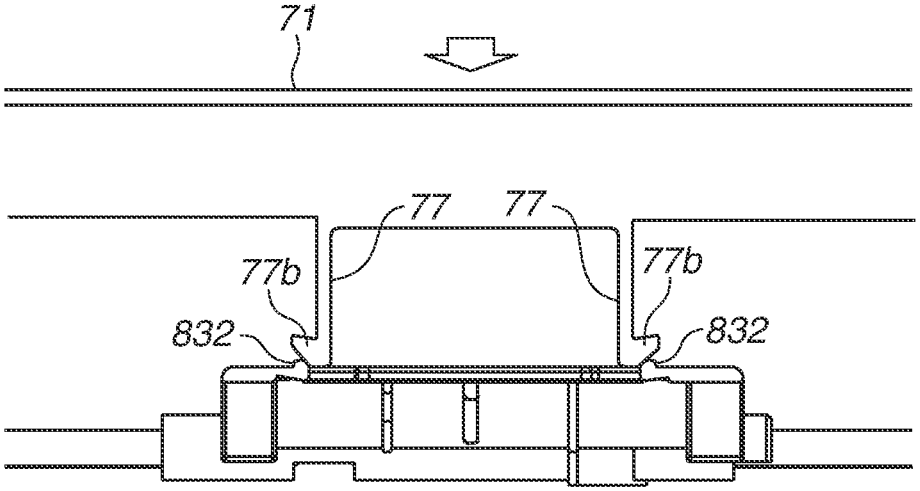

When the closing operation is further continued to rotate the handle 83 by the predetermined amount or more and the right and left lock engaging portions 84*a* each reach the predetermined position, the lock engaging portions 84*a* engage with the portions to be engaged 100*p*, as illustrated in FIG. 9A. As a result, the secondary transfer unit 80 is positioned at the closed position relative to the apparatus main body 100A.

In this manner, the secondary transfer unit 80 is moved synchronously with the double-sided unit 70 and is locked and positioned relative to the apparatus main body 100A. However, since the double-sided unit 70 is not locked yet, the user needs to further carry on the closing operation. In this case, the hook portions 77 are deformed and moved while the leading end thereof slides on the portion 832 of the handle 83 to be contacted, so that a part of the handle 83 is positioned between the double-sided door 71 and the hook portions 77 in the left-right direction. On the other hand, the double-sided lock portion 70*a* engages with the hook portion provided on the fixing unit, thereby positioning the double-sided unit 70 relative to the apparatus main body 100A (FIGS. 7A and 7B).

As described above, in the configuration according to the present exemplary embodiment, the user can close the two doors by performing the closing operation once. This leads to an improvement in usability.

In particular, in the present exemplary embodiment, the gap C is provided between the lock shaft 84*b* and the bearing portion 830 of the handle 83 that is rotated to release the engagement of the lock engaging portions 84*a* with the portions to be engaged 100*p*.

In the configuration in which the handle 83 does not include the gap C relative to the bearing portion 830 and the handle 83 is integrally formed with the bearing portion 830, after the hook portions 77 are moved in a direction deviating from the predetermined movement locus and the hook portions 77 contact the handle 83, the handle 83 cannot be moved on the basis of the position of each of the hook portions 77. As a result, the hook contact portion 77*b* of each hook portion 77 cannot contact the portion 833 of the handle 83 to be engaged. In this case, there is a possibility that the movement of the hook portions 77 may be hindered by the handle 83 and after the secondary transfer unit 80 is closed, the double-sided unit 70 cannot be closed and the handle 83 or one of the hook portions 77 may be damaged.

However, in the present exemplary embodiment, the gap C is provided between the lock shaft 84*b* and the bearing portion 830 of the handle 83 and the handle 83 can be moved by the amount corresponding to the gap C between the bearing portion 830 and the lock shaft 84*b* in the direction perpendicular to the lock shaft 84*b*. In this configuration, if the hook portions 77 are moved in a direction deviating from the predetermined movement locus and contact the handle 83, the handle 83 can be moved on the basis of the position of each of the hook portions 77.

More specifically, the orientation of the handle 83 is changed so that the hook engaging portion 77*b* of one of the hook portions 77 and the hook engaging portion 77*b* of the other one of the hook portions 77 sequentially contact the portion 833 of the handle 83 to be engaged. As a result, the hook engaging portion 77*b* of one of the hook portions 77 and the portion 833 of the handle 83 to be engaged, or the hook engaging portion 77*b* of the other one of the hook portions 77 and the portion to be engaged 833 of the handle 83 are brought into the predetermined contact state. As a result, the hook engaging portion 77*b* of each hook portion 77 can reliably contact the portion to be engaged 833 of the handle 83 and the double-sided unit 70 can be closed after the secondary transfer unit 80 is closed.

The handle 83 is disposed making the gap C relative to the secondary transfer conveyance guide 80*b*, and the handle 83 is configured to move on the basis of the position of each of the hook portions 77 without interfering with the secondary transfer conveyance guide 80*b*, so that advantageous effects of the present disclosure can be obtained.

A relationship between the hook portions 77 and the handle 83 in the closing operation process will be described in more detail below.

In the closing operation process, as described above, the hook portions 77 can provide a pressing force large enough to move the right and left lock engaging portions 84*a* to a predetermined position relative to the handle 83 so as to position the secondary transfer unit 80 relative to the apparatus main body 100A. A load to be applied in this case is represented by F1. A pressing force to be applied when the hook portions 77 are deformed to penetrate through the handle 83 and engage with the handle 83 to lock the double-sided unit 70 relative to the apparatus main body 100A is represented by F2.

When the double-sided unit 70 is closed, $F1<F2$ needs be desirably satisfied so that the secondary transfer unit 80 can be accurately locked relative to the apparatus main body 100A. In this case, the hook portions 77 each have a cantilever shape. Accordingly, the smaller the pressing force F2 required for deformation as a hitching amount between the hook portions 77 and handle 83, and the more the pressing force F2, the higher the hitching amount becomes. Further, the hitching amount can vary depending on a dimensional tolerance of each component and right and left gaps. Accordingly, it may be desirable to set a design nominal value for F2 to satisfy F1<F2 if the above-described variable factors are taken into consideration. On the other hand, since the pressing force F2 is a force to be applied when the user closes the double-sided unit 70, the pressing force F2 may be desirably set to a smaller value in terms of usability.

Figure 11:
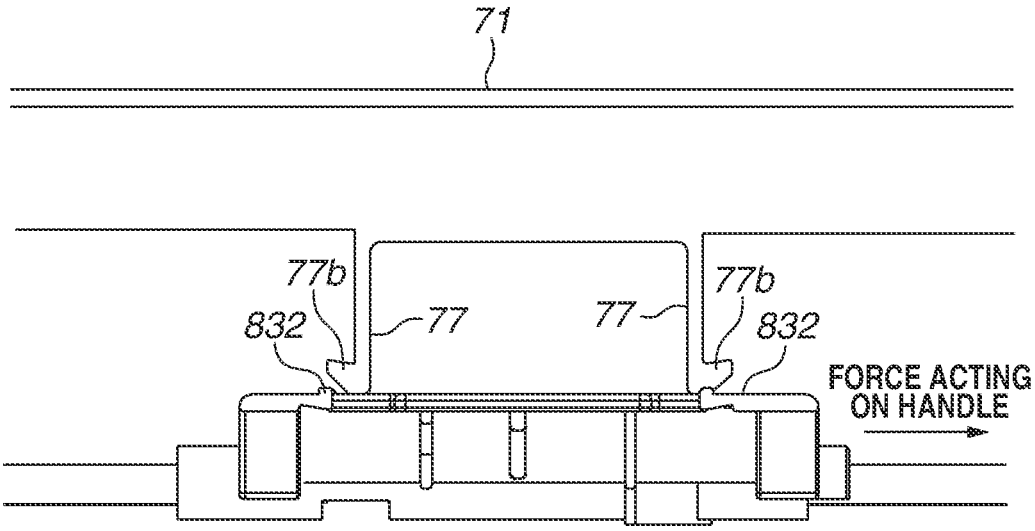
FIG. 11 illustrates a positional deviation between the handle and hook portions.

In the configuration according to the present exemplary embodiment, two claws of the hook portions 77 facing each other are used. Accordingly, even when the positions of the hook portions 77 and the handle 83 are deviated in the rotation axial direction as illustrated in FIG. 11, the handle 83 is moved in the axial direction due to the force acting in the rotation axial direction when the slope-like hook contact portion 77*b* and the portion to be contacted 832 contact each other. Thus, the handle 83 can be guided to a position where the forces of the right and left claws are uniformly applied, thereby suppressing a variation in the hitching amount of the hook portions 77.

Figure 12A:
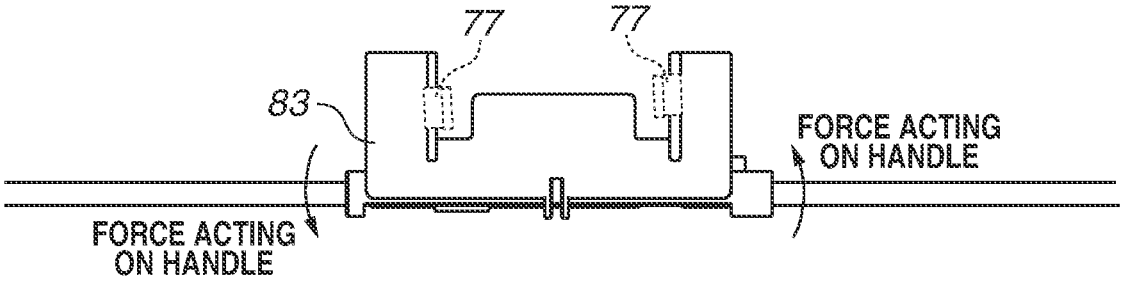
FIGS. 12A and 12B each illustrate a positional deviation between the handle and the hook portions.
Figure 12B:
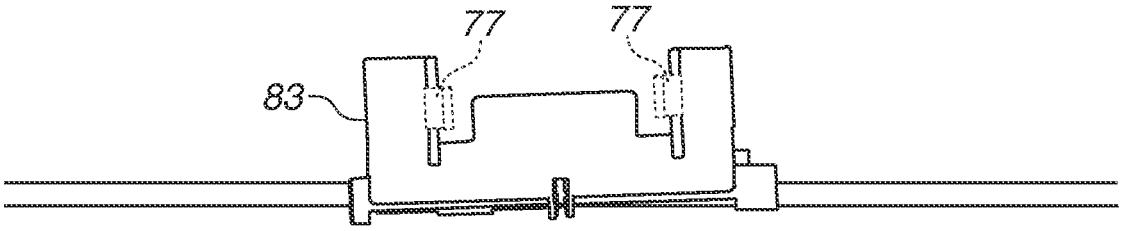

Further, since the secondary transfer unit 80 is positioned relative to the image forming apparatus main body 100A in the top-bottom direction, and the double-sided unit 70 is positioned relative to the fixing unit in the top-bottom direction, so that the hook portions 77 and the handle 83 may be inclined to each other. FIG. 12A is a sectional view illustrating the state of the hook portions 77 and the double-sided handle 83 in this case as viewed from the rear side of the apparatus main body 100A. Also as a result of the inclination, the hitching amount of the hook portions 77 may vary, or an imbalance may occur between the hitching amount on the right side and the hitching amount on the left side. This may cause a variation in the pressing force F2. In the configuration according to the present exemplary embodiment, as described in detail above with regard to the secondary transfer unit 80, the handle 83 is disposed with a gap formed relative to the lock shaft 84*b* and relative to the secondary transfer conveyance guide 80*b*. Accordingly, the handle 83 receives a force in a direction indicated by an arrow in FIG. 12A from the slop shape of the hook contact portion 77*b* and thus the handle 83 can move on the basis of the position of each hook portion 77 as illustrated in FIG. 12B. This configuration suppresses a variation in the hitching amount of the hook portions 77.

As described above, the configuration according to the present exemplary embodiment makes it possible to suppress a variation in the hitching amount of the hook portions 77 with respect to the positional deviation in the rotation axial direction, and the mutual inclination. Consequently, the design nominal value for F2 can be set to a smaller value, and thus an improvement in usability can be achieved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Applications No. 2019-140183, filed Jul. 30, 2019, and No. 2019-140184, filed Jul. 30, 2019, which are hereby incorporated by reference herein in their entirety.

What is claimed is:

1. An image forming apparatus comprising:

an apparatus main body including an image forming portion and a portion to be engaged;

an opening/closing unit provided to be rotatable relative to the apparatus main body and configured to take a first closed position for forming a conveyance path through which a recording material on which an image is formed is conveyed, and a first open position for opening the conveyance path, the opening/closing unit including (i) an interlock shaft, (ii) an engaging portion attached to the interlock shaft and configured to engage with the portion to be engaged to position the opening/closing unit at the first closed position, and (iii) a shaft rotating portion attached to the interlock shaft; and an opening/closing member provided to be rotatable relative to the apparatus main body and configured to take a second closed position for covering an opening provided in the apparatus main body that exposes the opening/closing unit, and for forming a double-sided conveyance path, and a second open position for opening the double-sided conveyance path, the opening/closing member including a protruding portion configured to engage the shaft rotating portion, wherein the engaging portion is attached to the interlock shaft so that one of the interlock shaft and the engaging portion rotates the other of the interlock shaft and the engaging portion, wherein, when the engaging portion engages with the portion to be engaged and the opening/closing member moves from the second closed position to the second open position, the protruding portion rotates the shaft rotating portion so that the interlock shaft is rotated by the shaft rotating portion and the engaging portion disengages from the portion to be engaged.

2. The image forming apparatus according to claim 1, wherein the portion to be engaged includes a first portion to be engaged and a second portion engaged, the engaging portion incudes (i) a first engaging portion configured to engage with the first portion to be engaged and provided at one end of the interlock shaft in the rotation axial direction of the opening/closing unit and (ii) a second engaging portion configured to engage with the second portion to be engaged and provided at the other end of the interlock shaft in the rotation axial direction of the opening/closing unit.

3. The image forming apparatus according to claim 1, wherein when the opening/closing unit is positioned at the first open position and the opening/closing member moves from the second open position to the second closed position, the opening/closing member contacts the opening/closing unit to move the opening/closing unit from the first open position to the first closed position, and the engaging portion is rotated by contacting the portion to be engaged in a state where the protruding portion contacts the shaft rotating portion.

4. The image forming apparatus according to claim 3, wherein the protruding portion includes a first protruding portion and a second protruding portion, wherein the shaft rotating portion is movable relative to the interlock shaft in a direction perpendicular to the interlock shaft so that one of the first protruding portion and the second protruding portion contacts the shaft rotating portion after the other of the first protruding portion and the second protruding portion contacts the shaft rotating portion.

5. The image forming apparatus according to claim 1, wherein the protruding portion has a hook shape.

6. The image forming apparatus according to claim 1, wherein the image forming portion includes a plurality of image bearing members and an intermediate transfer belt onto which developer images formed on a surface of the image bearing member are sequentially transferred, and wherein the opening/closing unit includes a secondary transfer roller configured to transfer a developer image formed on the intermediate transfer belt onto a recording material.

7. The image forming apparatus according to claim 1, wherein the shaft rotating portion is attached to the interlock shaft so that a gap is formed between the shaft rotating portion and the interlock shaft and the shaft rotating portion is movable relative to the interlock shaft in a direction perpendicular to the interlock shaft.

8. The image forming apparatus according to claim 7, wherein the opening/closing member is configured to rotate around a rotational axis parallel to the rotation axial direction of the opening/closing unit and to take the second closed position and the second open position.

9. The image forming apparatus according to claim 8, wherein the engaging portion includes a first engaging portion and a second engaging portion, wherein when the opening/closing unit is positioned at the first closed position and the opening/closing member moves from the second closed position to the second open position, the protruding portion engages with the shaft rotating portion to rotate the first engaging portion and the second engaging portion through the shaft rotating portion.

10. The image forming apparatus according to claim 2, the first engaging portion and the second engaging portion are configured to be integrally movable, if the first engaging portion contacts the portion to be engaged and is not positioned at a position where the first engaging portion can engage with the portion to be engaged, rotation of the second engaging portion is restricted.

11. The image forming apparatus according to claim 1, wherein the interlock shaft includes a receiving portion, and the shaft rotating portion includes a contacting portion configured to contact the receiving portion, wherein when the contact portion contacts the receiving portion and the shaft rotating portion rotates toward a first direction, the contact portion moves the receiving portion so that the interlock shaft is rotated toward the first direction, and wherein when the contact portion contacts the receiving portion and the interlock shaft rotates toward the first direction, the receiving portion is separated from the contact portion.

12. The image forming apparatus according to claim 11, wherein when the opening/closing unit moves from the first open position to the first close position, the engaging portion is rotated by contacting the portion to be engaged so that the receiving portion is separated from the contacting portion.

13. The image forming apparatus according to claim 1, further comprising: an urging member connected to the interlock shaft, wherein the interlock shaft is urged by the urging member so that the engaging portion is pressed against the portion to be engaged.

* * * * *